US008172250B2

(12) United States Patent
Krafft et al.

(10) Patent No.: US 8,172,250 B2
(45) Date of Patent: May 8, 2012

(54) ALPINE SKI WITH AN ADJUSTMENT ARRANGEMENT

(75) Inventors: Bertrand Krafft, Brison Saint-Innocent (FR); Gilles Silva, Le Montcel (FR); Christian Huyghe, Gruffy (FR)

(73) Assignee: Salomon S.A.S., Metz-Tessy (FR)

( * ) Notice: Subject to any disclaimer, the term of this patent is extended or adjusted under 35 U.S.C. 154(b) by 566 days.

(21) Appl. No.: 12/358,735

(22) Filed: Jan. 23, 2009

(65) Prior Publication Data

US 2009/0189370 A1 Jul. 30, 2009

(30) Foreign Application Priority Data

Jan. 25, 2008 (FR) ..... 08 00401

(51) Int. Cl.
*A63C 5/07* (2006.01)

(52) U.S. Cl. ..... 280/602; 280/601; 280/609

(58) Field of Classification Search ..... 280/11.12, 280/11.14, 601, 602, 609, 610, 809
See application file for complete search history.

(56) References Cited

U.S. PATENT DOCUMENTS

| | | | | |
|---|---|---|---|---|
| 2,071,220 | A * | 2/1937 | Schniebs | 280/609 |
| 2,164,604 | A * | 7/1939 | Whiteford | 280/610 |
| 3,132,874 | A * | 5/1964 | Baudou | 280/610 |
| 3,173,161 | A * | 3/1965 | Amsbry | 441/68 |
| 3,300,226 | A * | 1/1967 | Reed, Jr. | 280/602 |
| 3,398,968 | A * | 8/1968 | Mutzhas | 280/602 |
| 3,747,947 | A * | 7/1973 | Gunzel | 280/602 |
| 3,827,096 | A * | 8/1974 | Brownson | 441/68 |
| 3,894,745 | A * | 7/1975 | Heim et al. | 280/610 |
| 4,221,400 | A * | 9/1980 | Powers | 280/602 |
| 4,300,786 | A * | 11/1981 | Alley | 280/602 |
| 4,377,297 | A * | 3/1983 | Staufer | 280/609 |
| 4,679,813 | A * | 7/1987 | Girard | 280/602 |

(Continued)

FOREIGN PATENT DOCUMENTS

FR 1 470 094 A 2/1967

(Continued)

*Primary Examiner* — Hau Phan
*Assistant Examiner* — Jacob Meyer
(74) *Attorney, Agent, or Firm* — Greenblum & Bernstein, P.L.C.

(57) ABSTRACT

A ski including a structural unit, gliding structure, as well as a decorative and protective structure. The structural unit includes at least one lower reinforcement, at least one upper reinforcement, and an intermediate structure, or core, positioned between the upper reinforcement and the lower reinforcement. The ski has a longitudinally extending cambered shape such that, when the gliding structure is positioned on a flat surface, the ski rests on a shovel contact point and a tail contact point. The ski further includes a tension structure that exerts a tension force between a first anchoring, positioned longitudinally beyond the shovel contact zone, and a second anchoring, positioned on rearward of the shovel contact zone. The tension structure is positioned for most of its length beneath the decorative and protective structure, such tension structure being positioned for most of its length above the neutral axis of the ski, such as above the upper reinforcement. The tension structure further includes a tensioning device that makes it possible to position the second anchoring in at least two positions separated longitudinally from one another by a distance between 0.5 mm and 10.0 mm, or between 1.0 mm and 7.0 mm. The tension structure includes a metal blade. The decorative and protective structure can include a window across which the blade can project. A filler can be positioned between the decorative and protective structure and the upper reinforcement, and a tunnel is arranged in the filler in order to receive the blade.

28 Claims, 6 Drawing Sheets

U.S. PATENT DOCUMENTS 4,700,967 A * 10/1987 Meatto et al. ..... 280/609
4,715,612 A * 12/1987 Fels et al. ..... 280/609
4,731,038 A * 3/1988 Hancock et al. ..... 441/68
4,756,544 A * 7/1988 Abondance et al. ..... 280/609
4,953,884 A * 9/1990 Diard et al. ..... 280/609
4,961,592 A * 10/1990 Diard et al. ..... 280/609
4,971,349 A * 11/1990 Diard et al. ..... 280/609
4,995,631 A * 2/1991 Hunter ..... 280/607
5,096,217 A * 3/1992 Hunter ..... 280/607
5,183,618 A * 2/1993 Pascal et al. ..... 264/257
5,230,527 A * 7/1993 Varan ..... 280/609
5,242,187 A * 9/1993 Diard et al. ..... 280/609
5,280,943 A * 1/1994 Commier et al. ..... 280/609
5,286,051 A * 2/1994 Scherubl ..... 280/607
5,320,377 A * 6/1994 Ruffinengo ..... 280/602
5,335,931 A * 8/1994 Lacroix et al. ..... 280/602
5,393,085 A * 2/1995 Forneri ..... 280/602
5,405,161 A * 4/1995 Petkov ..... 280/609
5,445,403 A * 8/1995 Cazaillon et al. ..... 280/610
5,447,322 A * 9/1995 le Masson et al. ..... 280/602
5,496,053 A * 3/1996 Abondance ..... 280/609
5,498,016 A * 3/1996 Jodelet ..... 280/602
D375,341 S * 11/1996 Andrevon et al. ..... D21/766
5,615,905 A * 4/1997 Stepanek et al. ..... 280/602
5,725,237 A * 3/1998 Krafft et al. ..... 280/609
5,727,807 A * 3/1998 Krafft et al. ..... 280/609
5,820,154 A * 10/1998 Howe ..... 280/602
5,871,225 A * 2/1999 Sutherland ..... 280/609
6,000,711 A * 12/1999 Fey et al. ..... 280/603
6,059,308 A * 5/2000 Baudin et al. ..... 280/610
6,079,746 A * 6/2000 Olsen ..... 280/809
6,182,998 B1 * 2/2001 Huyghe et al. ..... 280/602
6,217,041 B1 * 4/2001 Hauser et al. ..... 280/14.22
6,241,272 B1 * 6/2001 Hammerle ..... 280/609
6,357,782 B1 * 3/2002 Pieber et al. ..... 280/609
6,631,918 B2 * 10/2003 Silva ..... 280/607
6,857,653 B2 * 2/2005 Wilson ..... 280/602
6,883,823 B2 * 4/2005 Riepler et al. ..... 280/602
6,886,848 B2 * 5/2005 Riepler ..... 280/602
7,011,331 B2 * 3/2006 Riepler ..... 280/601
7,134,680 B2 * 11/2006 Emig et al. ..... 280/602
7,264,262 B2 * 9/2007 Zanco ..... 280/602
7,296,818 B2 * 11/2007 Krumbeck et al. ..... 280/607
7,338,066 B2 * 3/2008 Riepler ..... 280/610
7,344,150 B2 * 3/2008 Poellmann ..... 280/607
7,360,782 B2 * 4/2008 Gignoux ..... 280/602
7,396,036 B2 * 7/2008 Barbieri et al. ..... 280/601
7,419,179 B2 * 9/2008 Zanco et al. ..... 280/602
7,690,674 B2 * 4/2010 Trimble et al. ..... 280/609
7,887,079 B2 * 2/2011 Krafft ..... 280/602
2001/0052679 A1 * 12/2001 Stubblefield ..... 280/14
2003/0006584 A1 * 1/2003 Carlson ..... 280/609
2003/0111824 A1 * 6/2003 Riepler ..... 280/610
2003/0234513 A1 * 12/2003 Zanco ..... 280/602
2004/0026893 A1 * 2/2004 Donze ..... 280/602
2004/0046362 A1 * 3/2004 Restani ..... 280/602
2004/0100067 A1 * 5/2004 Riepler et al. ..... 280/602
2004/0150190 A1 * 8/2004 Marion et al. ..... 280/601
2005/0006875 A1 * 1/2005 Donze et al. ..... 280/602
2005/0167948 A1 * 8/2005 Riepler ..... 280/610
2005/0206129 A1 * 9/2005 Stritzl et al. ..... 280/609
2005/0212260 A1 * 9/2005 Poellmann ..... 280/609
2005/0248126 A1 * 11/2005 Degasperi et al. ..... 280/601
2006/0145451 A1 * 7/2006 Wilson ..... 280/602
2008/0042400 A1 * 2/2008 Smith et al. ..... 280/609
2008/0073875 A1 * 3/2008 Krafft ..... 280/601
2008/0106069 A1 * 5/2008 Holzer et al. ..... 280/602
2008/0185816 A1 * 8/2008 Riepler et al. ..... 280/602
2010/0084838 A1 * 4/2010 Burcher ..... 280/601
2010/0148472 A1 * 6/2010 Phelipon et al. ..... 280/602
2010/0237588 A1 * 9/2010 Krause et al. ..... 280/608
2010/0327560 A1 * 12/2010 Silva ..... 280/602
2011/0001304 A1 * 1/2011 Dutaut et al. ..... 280/601
2011/0001306 A1 * 1/2011 Canaday et al. ..... 280/609
2011/0121542 A1 * 5/2011 Krafft ..... 280/609

FOREIGN PATENT DOCUMENTS

FR 2 448 360 A1 9/1980
WO WO-02/40115 A1 5/2002
WO WO-03/039686 A1 5/2003

* cited by examiner

Fig. 1
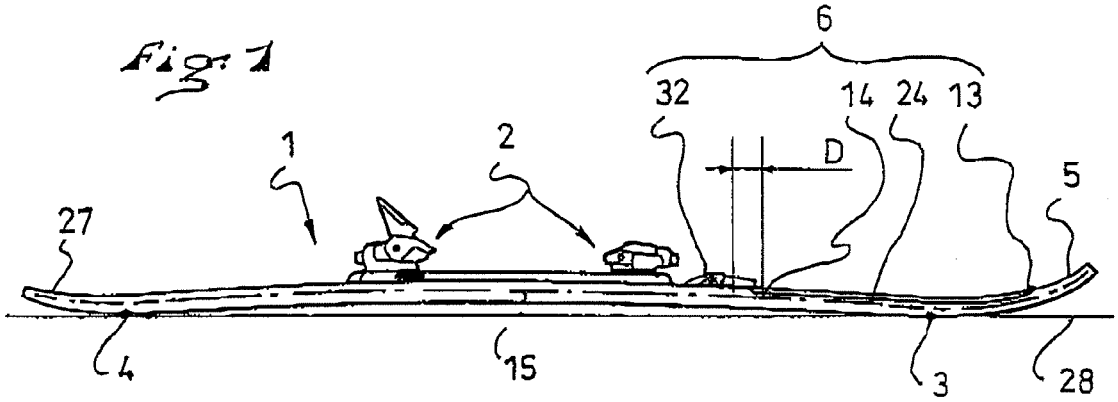
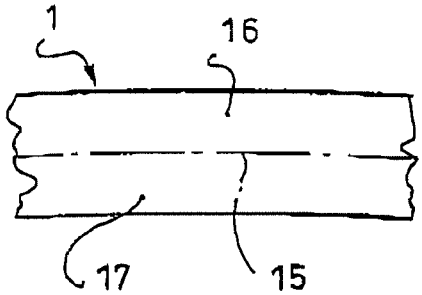
Fig. 2
Fig. 3
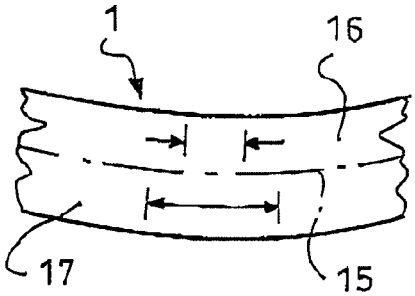
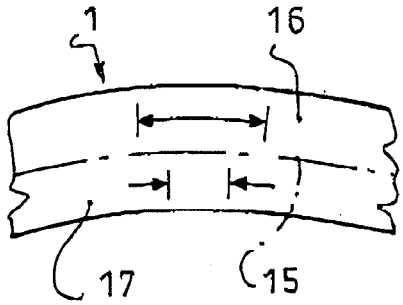
Fig. 4

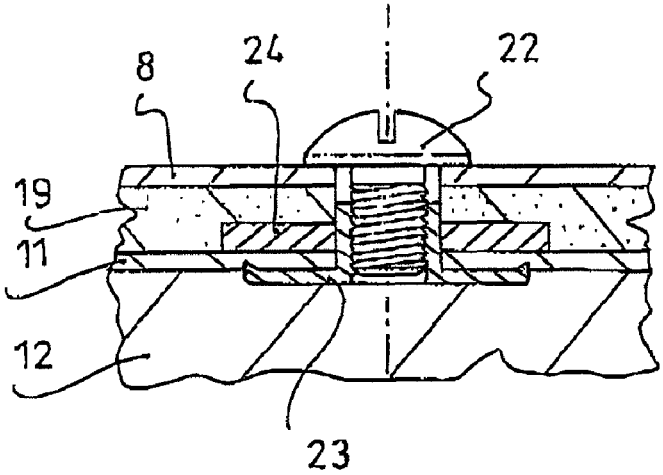
Fig. 7
Fig. 8
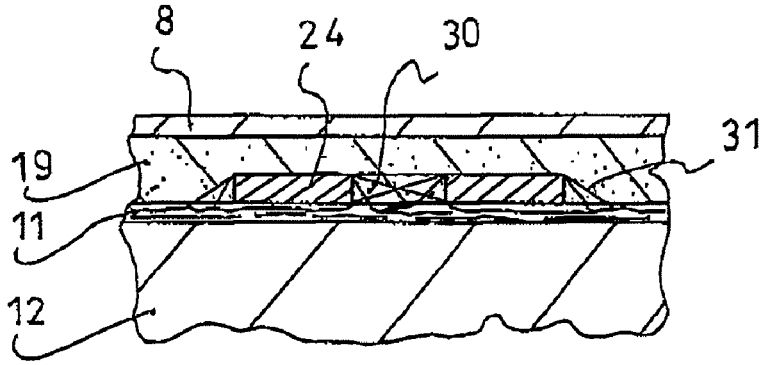

ALPINE SKI WITH AN ADJUSTMENT ARRANGEMENT

CROSS-REFERENCE TO RELATED APPLICATION

This application claims priority under 35 U.S.C. §119 of French Patent Application No. 08 00401, filed on Jan. 25, 2008, the disclosure of which is hereby incorporated by reference thereto in its entirety.

BACKGROUND OF THE INVENTION

1. Field of the Invention

The invention relates to a pair of skis, the construction of which is improved.

2. Description of Background and Other Information

The choice of the ski characteristics, in particular those characteristics that are related to length, geometry, rigidity, and the length and height of its shovel, is a function of a number of criteria, such as the skier's skill level in the discipline being practiced. the quality of the snow, the type of activity (recreation, sport, competition, free-ride, off-piste skiing).

In general, skis are designed either for a specific use corresponding to a small number of criteria, or for general use. When designed for a specific use, the ski becomes difficult to use as soon as the conditions of use vary from those for which it was conceived. On the other hand, when the ski is designed for general use, its operation is never optimal for a particular use.

Understandably, it is desirable for the skis to function satisfactorily regardless of snow conditions, whether the snow is packed or hard, as can be found on the trail at the beginning of the day, or whether the snow is soft, almost melted, as is the case at the end of the day in spring.

To his end, the patent document FR 2 448 360 proposes a device that enables one to adjust the characteristics of the ski on the spot. This device makes it possible to modify the camber of the ski and includes means for varying the flexibility and the elasticity of the ski.

This device is complex and requires installing elements that weigh down the ski and, thereby, modifying its behavior. Furthermore, this device requires the presence of a cable that droops vertically between two points positioned between the median portion of the ski and the shovel contact point. This arrangement then produces large, bulky elements which can negatively affect the behavior of the ski, as well as making the ski less aesthetically appealing.

SUMMARY OF THE INVENTION

The present invention overcomes the disadvantages of the prior art, including those disadvantages mentioned above.

More particularly, the Invention provides a ski, the characteristics of which can be adjusted depending upon a plurality of criteria, and in particular the quality of the snow.

In addition, the invention provides a ski having an integrated adjustment arrangement.

Further, the invention provides a ski equipped with an arrangement which enabling such characteristics to be adjusted, while preserving a satisfactory aesthetic appearance.

Still further, the Invention provides a ski whose geometry, in particular the height of the shovel, can be adjusted without its rigidity being modified, Still further, the present invention provides a sli whose geometry can be adjusted, in particular the contact zone of the front portion of the ski with a flat surface on which it is positioned. The contact zone of the front portion of the ski is also called the shovel contact point.

Still further, the invention provides a ski that has an adjustment arrangement enabling a user to adapt the ski to the conditions in which he/she wishes to practice alpine skiing, and in particular to have an "on-piste position" and an "off-piste position".

To these and other ends, the invention comprises a ski having a structural assembly, a gliding structure, as well as a decorative and protective structure. The structural assembly includes at least one lower reinforcement, at least one upper reinforcement, and a structure interposed between the upper reinforcement and the lower reinforcement, i.e., such as a core. Along its length, the ski has a cambered profile such that, when the gliding structure is positioned on a planar surface, the ski rests on a front contact line and a rear contact line. The ski further includes a tension structure exerting a tension force between a first anchoring position, forward of the front contact line and a second anchoring position, rearward of the front contact line. The tension structure is positioned for most of its length beneath the decorative and protective structure and, also for most of its length, above the neutral axis of the ski. In addition, the tension structure includes a tensioning device making it possible to locate the second anchoring position in at least two points separated longitudinally from one another by a distance D.

The first position of the second anchoring corresponds to the "on-piste position"; the second position corresponds to the "off-piste position".

The structural assembly constitutes the "engine" of the ski, because the cooperation between the upper and lower reinforcements and the interposed structure/core defines the mechanical behavior of the ski, and in particular the bending behavior. Given that the ski has a certain thickness, a neutral axis can be defined when describing the ski bending behavior. The neutral axis refers to the zone of the ski where the bent ski works only in flexion. All of the zones which are one side or on another side of the neutral axis work in compression or in tension.

Advantageously, the tension structure is positioned for most of its length above the upper reinforcement.

Advantageously, the first anchoring is fixed to the structural unit by screws and bolts or by way of composite fabrics.

Advantageously, the distance D is between 0.5 mm and 10 mm or, in a more particular embodiment, between 1 mm and 7 mm.

Advantageously, the tension structure includes a blade made of metal or of another material.

Advantageously, the blade is positioned for most of its length above the upper reinforcement.

Advantageously, the tension structure includes a tensioning device for tensioning the tension structure, and thus for generating the displacement of the second anchoring, from the first position (on-piste position) to the second position (off-piste position). The tensioning device is capable of producing a force greater than 70 daN and, in a more particular embodiment, greater than 100 daN.

Advantageously, the traction structure includes an elastic mechanism with a high modulus of elasticity. By way of example, in the case in which such elastic mechanism includes a spring, a spring is used having a stiffness constant greater than 5000 N/m or, in another embodiment, greater than 10000 N/m.

Advantageously, the decorative and protective structure includes a window through which the blade can project.

Advantageously, a filler is positioned between the decorative and protective structure and the upper reinforcement, and a tunnel is arranged in the filler in order to receive the blade.

BRIEF DESCRIPTION OF DRAWINGS

The invention will be better understood upon reading the description that follows, with reference to the annexed drawings, and in which;

FIG. 1 is a ski according to the invention;

FIGS. 2, 3 and 4 are partial and schematic views of the ski shown in FIG. 1;

FIG. 7 is a detailed view of the first anchoring of the blade;

FIG. 8 is a detailed view of an alternative version of the first anchoring of the blade;

FIG. 9 is a top view showing the traction member;

DETAILED DESCRIPTION OF THE INVENTION

Figure 5:
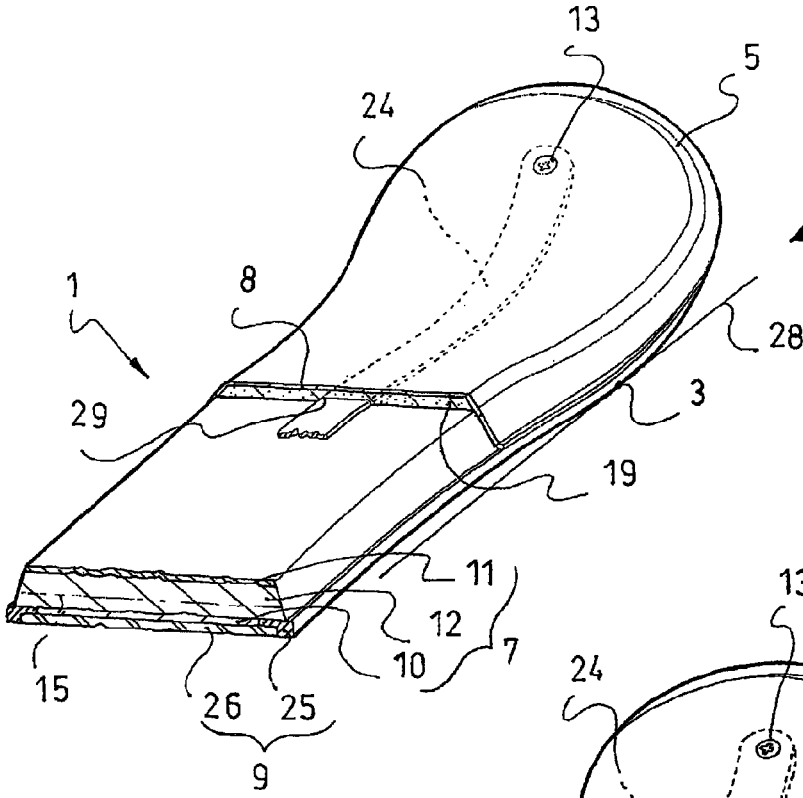
FIG. 5 is a perspective view of the front portion of the ski shown in FIG. 1, when the latter is adjusted in the on-piste position.

FIG. 1 illustrates a ski according to a first embodiment of the invention. The ski 1 is equipped with a safety binding device 2, which is positioned in the central zone of the ski. In a known manner, the ski includes a structural unit, a gilding structure, as well as a decorative and protective structure. The structural unit constitutes the "engine" of the ski. The structural unit includes at least one lower reinforcement (or lower reinforcement layer), at least one upper reinforcement (or upper reinforcement layer), and an Interposed structure, or intermediate structure, between the lower reinforcement and the upper reinforcement. The cooperation between the upper and lower reinforcements and the interposed structure forms a sandwich structure, which defines the mechanical behavior of the ski, and in particular its bending, i.e., its behavior in flexion. The gliding structure includes a sole made out of a material that promotes gliding, as well as a pair of side running edges, which are usually made of a metallic material. The decorative and protective structure covers the entire upper portion of the ski. It may or may not also contribute to the mechanical behavior of the ski. The interposed structure, also called the core, can be made in any of a variety of fashions. It can be shaped prior to being positioned in the mold during the manufacture of the ski. In this case, one would then refer to a "glued ski," However, the Interposed structure, or core, can also be shaped during injection in the mold. one would then refer to an "injected ski." This interposed structure has a substantial thickness, about 1.0 cm in a particular embodiment. This thickness is not constant over the entire length of the ski. In general, it reaches its maximum in the central zone of the ski, in the zone where the safety bindings 2 are to be mounted, and it is thinner at the ends of the ski, in the area of the shovel 5 and in the area of the tail 27.

When resting on a planar, or flat, surface 28, the ski 1 is in contact with the surface 28 only in two zones, namely, at the shovel contact line PCS 3 and at the tall contact line PCT 4; in the two-dimensional side view (such as in FIG. 1), these can be referred to as shovel contact point 3 and tail contact point 4. Between the shovel contact point 3 and the tail contact point 4, the profile of the lower surface of the ski follows a concave curve; this curve is referred to as the ski camber. The raised shovel portion 5 is located beyond the shovel contact point 3, toward the front of the ski. The tall 27 is located beyond the tail contact point 4, toward the rear of the ski. The tail may or may not be raised.

Given that the ski has a certain thickness, one can define a neutral axis, or neutral plane, when describing the bending behavior of the ski.

Figure 3:
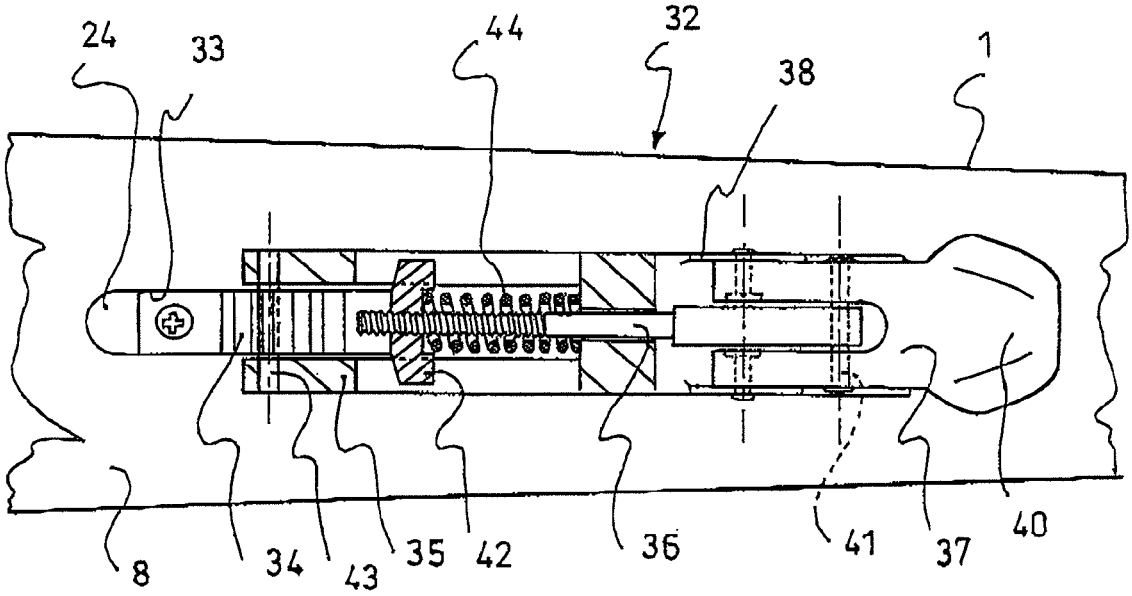

FIGS. 2, 3, and 4 show how the neutral axis of the ski is defined. Each of these drawing figures schematically shows a portion of the ski 1 in various states of bending, or flexion.

In FIG. 2, the ski is at rest; no force is exerted thereon.

In FIG. 3, the ski 1 is subject to bending deformation. This is typically the case when the skier exerts a strong pressure on the ski using his/her weight and the muscular strength of his/her legs. In this case, given that the ski has a certain thickness, its upper portion works in compression, whereas its lower portion works in tension. The boundary between these two zones constitutes a zone that works neither in compression nor in tension. This zone is called the neutral axis 15 or, in three dimensions, the neutral plane. The zone located above the neutral axis 15 is called the over-neutral-axis volume 16, while the zone located beneath the neutral axis 15 is called the under-neutral-axis volume 17.

When the skier eases the force he/she exerts on the ski, the elasticity of the structural unit generates a counter-bending deformation of the ski, as shown in FIG. 4. In such a case, the over-neutral-axis volume 16 works in tension, while the under-neutral-axis volume 17 works in compression.

As can be seen in FIG. 1, the ski according to the invention includes a tension structure 6 that exerts a tension force between a first anchoring 13 and a second anchoring 14. The first anchoring 13 is positioned in the area of the shovel 5, forward of the shovel contact point 3. The second anchoring 14 is positioned rearward of the shovel contact point 3.

The tension structure 6 can be positioned, selectively, in the "on-piste position", which is the position shown in FIG. 1, and in an "off-piste position". In the "off-piste position", the second anchoring 14 is moved rearwardly by a distance D with respect to the position that it occupies in the "on-piste position". The distance D can be between 0.5 mm and 10.0 mm. However, depending upon the desired effect and the desired amplitude of the shovel raised portion, the distance D can be chosen to be between 1.0 mm and 7.0 mm. The tension structure 6 includes a blade 24 that connects the first anchoring 13 to the second anchoring 14. In the "off-piste position", the rearward movement of the second anchoring 14 causes the shovel 5 to be raised.

According to the invention, the tension structure 6 is positioned in the over-neutral-axis volume 16, i.e., above the neutral axis 15. Furthermore, the tension structure is essentially integrated into the ski 1, i.e., positioned beneath the decorative and protective structure 8.

Figure 6:
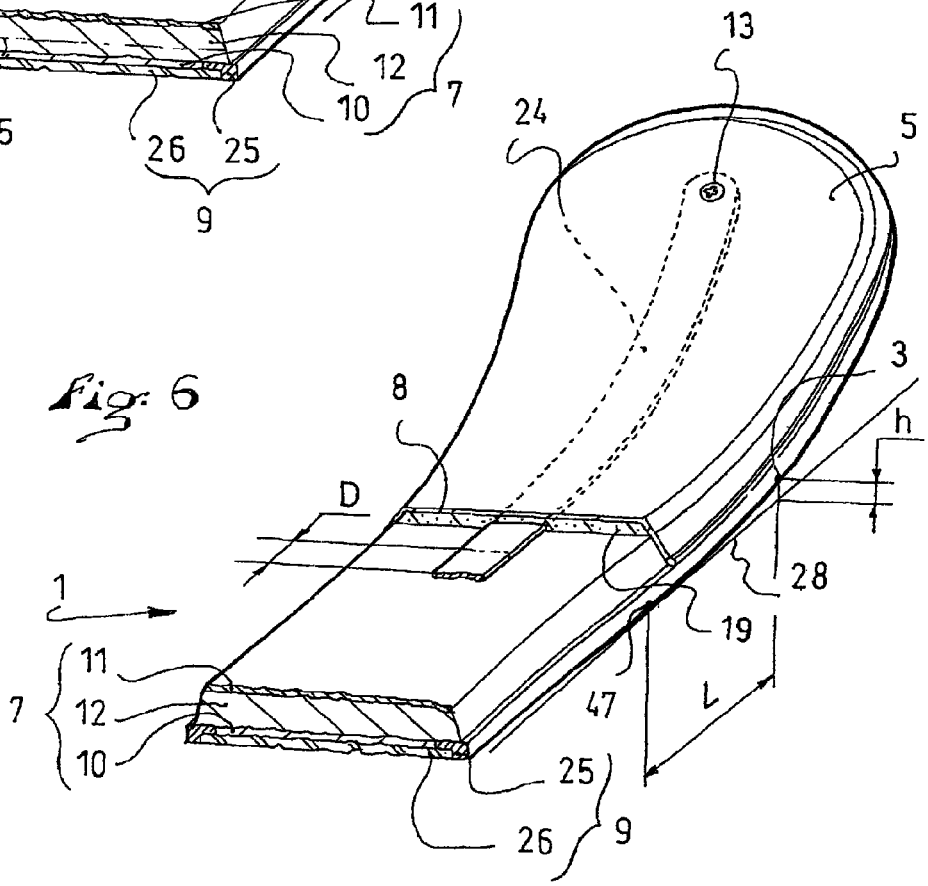
FIG. 6 is a view similar to FIG. 5, when the ski is adjusted in the off-piste position.

FIGS. 5 and 6 illustrate the front portions of the ski illustrated in FIG. 1, in the "on-piste position" and "off-piste position", respectively. These two drawing figures are partial perspective cross-sectional views.

In a known fashion, the ski 1 includes a structural unit 7, a gliding structure 9 and a decorative and protective structure 8. Such a construction is widely known in the prior art, and is not described further here. The gliding structure 9 includes those elements which provide the ski-snow interface, and they include an element which promotes gliding, namely the sole 26, and elements which are important for the steering of the ski, namely the running edges 25.

The structural unit 7 provides the ski with its mechanical characteristics, i.e., flexibility, elasticity, etc.

The structural unit 7 includes one or more lower reinforcements 10, one or more upper reinforcements 11, and one interposed structure 12, or core structure.

The structural unit 7 is covered by the protective and decorative structure 8. This construction comes in contact with the running edges 25 and ensures that the assembly is Impervious. In order to make the ski more attractive, this construction constitutes the support for the decoration of the ski. The protective and decorative structure can also include lateral edges that are supported on the running edges and/or the upper reinforcement (not represented).

A filler 19 is inserted between the upper reinforcement 11 and the decorative and protective structure 8. The filler 19 can be made of polyurethane foam, for example, or any equivalent material. It can be made of the same material as the intermediate or core structure 12. Because the filler is positioned above and higher than the upper reinforcement, it has almost no effect on the mechanical characteristics of the ski; it is not part of the structural unit 7.

A tunnel 29 extends longitudinally through the filler 19, in which the blade 24 of the tension structure 6 passes. As shown id FIGS. 5 and 6, e.g., the blade 24 is position above an uppermost upper reinforcement 11. The blade 24 is made of a metal foil, i.e., a thin metal sheet, having a width comprised, for example, between 5.0 and 25.0 mm, and a thickness between 0.4 and 1.0 mm. In the illustrated embodiment, the blade is 12.7 mm wide and 0.5 mm thick.

The blade 24 is capable of becoming deformed in flexion, in a direction perpendicular to its greater width, but practically does not become deformed when it is subject to tension in the direction of its length.

The blade is not required to be made of a metal foil. Other materials, such as carbon, i.e., carbon fibers, for example, can also be used.

The length of the blade 24 is dependent upon the length of the ski on which the tension structure 6 is installed. In any event, the blade 24 extends from the first anchoring 13, which is positioned in the area of the shovel 5 beyond the shovel contact point 3 (PCS), to the second anchoring 14, which is located on the opposite side of the same point (PCS). In a particular embodiment, the second anchoring 14 is in the area of the safety bindings, in the central portion of the ski 1.

The first anchoring 13 affixedly fixes the blade 24 to the ski and, in a particular embodiment, to the structural unit 7.

FIG. 7, illustrates a first embodiment of the first anchoring 13, which comprises an assembly of a screw 22 and insert 23. The threaded insert 23 is positioned beneath the upper reinforcement 11. It includes a plate, equipped with prongs that penetrate into the reinforcement 11, preventing the rotation of the insert 23. It also includes a threaded barrel, which extends through the upper reinforcement 11, the blade 24, the filler 19, and possibly all or part of the protective and decorative structure 8.

FIG. 8 illustrates an alternative embodiment of the first anchoring 13.

The blade 24 includes a slit 30 at its end, through which passes a panel 31 of fiber fabrics of the same type as the fabric used for the upper reinforcement 11. The panel 31, as the upper reinforcement 11, is embedded in a resin matrix which, after cross-linking, solidifies the unit. The final anchoring of the blade on the upper reinforcement is then carried out.

Besides the first anchoring 13 which affixes the blade 24 to the structural unit 7, the blade 24 is connected neither to the upper reinforcement 11, nor to the filler 19. Furthermore, to enable the blade 24 to slide more easily inside the tunnel 29, a layer or a substance that reduces frictional resistance can be applied to the walls of the tunnel 29 and to the upper reinforcement 11.

As described above, FIG. 5 depicts the ski according to the invention in the "on-piste position", whereas FIG. 6 depicts the ski in the "off-piste position".

In the "off-piste position", tension is exerted on the blade 24. This tension is generated by the displacement, by a distance D, of the second anchoring 14 of the blade 24. The tension exerted on the blade in the area of the second anchoring 14 of the blade is transmitted to the structural unit 7 of the ski 1, in the area of the first anchoring 13, and generates an upward and rearward displacement of the latter.

As a result, the raised portion of the shovel 5 is accentuated, and the shovel contact point moves rearward simultaneously.

With respect to the accentuated shovel raised portion, the amplitude of such accentuation can be evaluated by measuring the distance separating the sole of the ski from a horizontal surface on which it rests.

In the area of the shovel contact point 3 (PCS), this distance is zero by definition when the ski is in the "on-piste position", When the ski is in the "off-piste position", this same point 3 is moved upward by a value between 2.0 and 15.0 mm, in particular equal to 5.0 mm.

With respect to the rearward movement of the shovel contact point, its amplitude can be evaluated by measuring the length L (see FIG. 6) separating the shovel contact point 3 (when the ski is in the on-piste position) from the rearwardly-moved contact point 47. The rearwardly-moved contact point 47 corresponds to the zone of the sole of the front portion of the ski, which is in contact with a planar surface on which the ski rests when in the "off-piste position". The length L is between 20 mm and 500 mm. Good performance, i.e., a good behavior of the ski in the "off-piste position", is achieved when the length L is between 50 mm and 300 mm.

FIG. 9 shows a top view of the tensioning device 32, which exerts tension on the blade 24 of the tension structure 6.

The tensioning device 32 is fixed on the ski, in front of the safety binding. It comprises a base 38 fixed to the ski via two screws. The base 38 is created by bending a metal sheet. The base 38 includes two axial support pins projecting perpendicularly from the base thereof, which lie flat against the upper surface of the ski. A lever 37, having a pair of arms and a plate 40, is pivotally mounted on the base 38, each arm being pivotally mounted with respect to one of the support pins. The two arms are connected to one another via the plate 40, which functions as a handle or manipulatable member, i.e., a toolless member for gripping and actuating the tensioning device 32.

A connecting member or rod 36 is positioned between the two arms of the lever 37. It is connected at one of its ends to the lever 37 by means of a pivot pin 41. The connecting rod 36 is connected by its other end and to a buckle 35, The connection between the connecting rod 36 and the buckle 35 is a sliding connection and is made via a plate 42, which is affixed to the connecting rod and is capable of sliding in the buckle 35. The sliding amplitude of the plate 42 is very reduced and constrained by a spring 44 having a high modulus of elasticity.

A slot 33 arranged in the protective and decorative structure 8 of the ski enables the blade 24 to exit from the tunnel 29 and to allow its end to be accessible. A rack 34 is fixed on this end by means of a screw. The rack 34 includes a minimum of one tooth, but could include two, three, or more teeth.

The buckle 35 is shown to be bearing against the teeth of the rack 34 via the transversely extending pin or rod 43.

Figure 11:
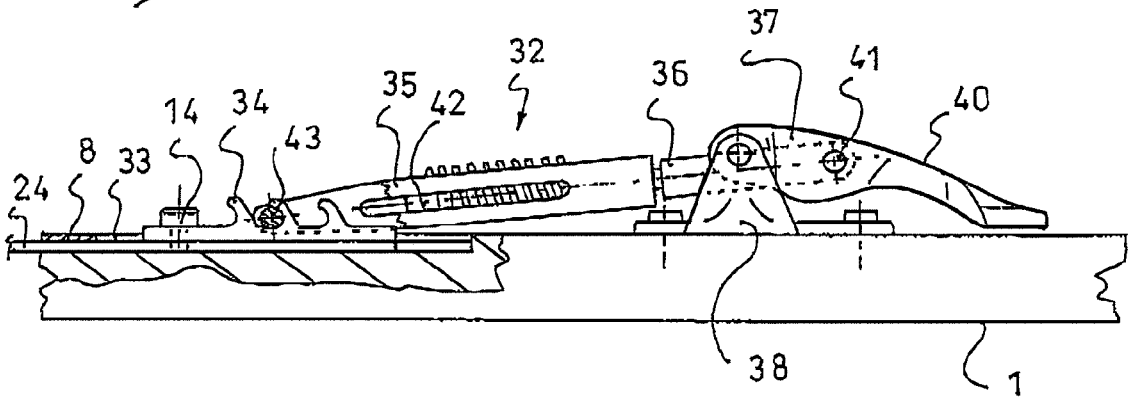
FIGS. 10 and 11 are side views of the traction member.
Figure 10:
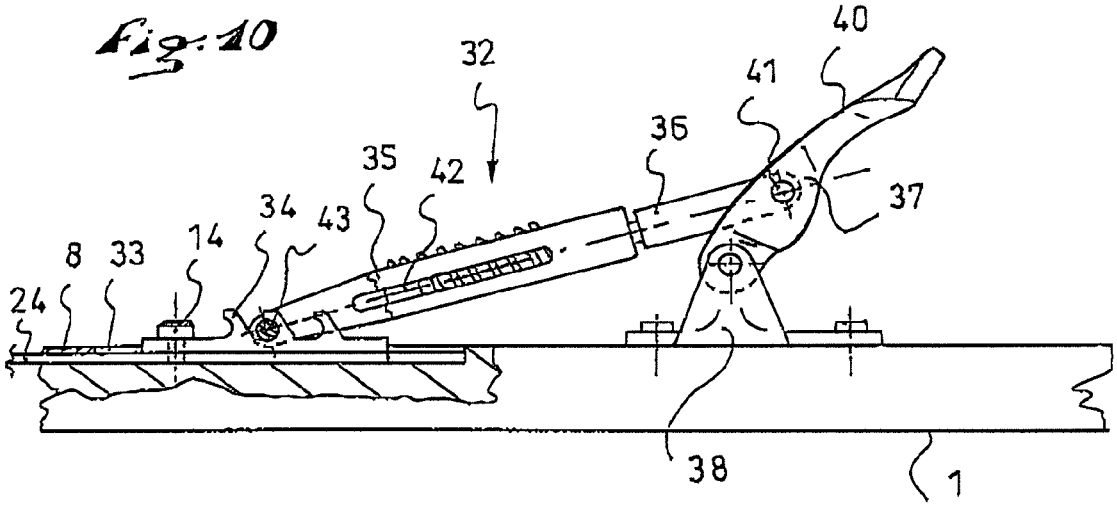

FIG. 10 shows a side view of the tensioning device prior to being manipulated. The rod 43 is positioned in the hollow portion of one of the teeth of the rack 34. The user exerts pressure on the lever 37, which is converted into a tension force on the blade 24. This tension force causes a displacement of the blade by a distance equal to D. Due to the knuckle joint mechanism constituted by the non-alignment of the three axes, namely, those of the rod 43, the axis support of the base 38, and the pivoting support pin 41, the tensioning of the blade is maintained as long as the lever remains in low position. The low position of the lever 37 is the position that is shown in FIG. 11.

The lever enables a reduction in the force which the user has to apply for actuating the tension structure 6. The force necessary to put the tension structure in the "off-piste position" is, in a particular embodiment, between 70 daN and 160 daN.

Advantageously, the tensioning device 32 includes an elastic mechanism which works in the longitudinal direction of the ski and which has a high modulus of elasticity. This elastic mechanism is in the form of spring 44 in the illustrated embodiment. The spring stiffness constant is greater than 5000 N/m and, in a particular embodiment, greater than 10000 N/m. The elastic mechanism serves several functions. In particular, it makes it possible to absorb the impacts, i.e., shocks, when the ski goes into a camber. In addition, because the displacement of the second anchoring point is relatively short, the slight slackness provided by the elastic mechanism is necessary for the tensioning device 32 to function correctly.

Advantageously, the rack 34 has a plurality of teeth that are spaced apart. It is possible to provide a tooth that is positioned such that, when the rod 43 is engaged therein, no tension is exerted on the blade 24. Thus, even when the tension structure 6 is in the "on-piste position", the lever 37 is also in a position in which it is folded back against the upper surface of the ski 1.

The tensioning device 32 shown in FIGS. 9, 10, and 11 is only exemplary of that which can be used in the context of the invention. Such a tensioning device must be capable of being set in two stable positions, including a free position and a tensioned position. The free position corresponds to the "on-piste position" of the tension structure 6. In this position, the tensioning device exerts no force on the blade 24. The latter is then affixedly fixed on the structural unit 7 of the ski 1, in the area of the first anchoring 13, but is free to slide with respect thereto at any other point of its length, and in particular in the area of the second anchoring 14. The blade plays little or no role in the behavior of the ski, in its mechanical characteristics.

When the tensioning device 32 is tensioned, this corresponds to the "off-piste position" of the tension structure. In this position, the blade 24 is tensioned. However, because of the positioning of the tension structure 6 in the over-neutral-axis volume 16, each bending of the ski, i.e., the raising of the end zones (shovel, tail) with respect to the central portion (see FIG. 3), results in a slackening of the blade 24, even a buckling thereof. Consequently, the bending rigidity of the ski is not modified by the presence of the tension structure 6, whether the latter is in the "on-piste position" or in the "off-piste position".

On the other hand, the tension structure 6 has an effect when the ski works in counter bending, i.e., when the ends of the ski (shovel, tail) move downward with respect to the central portion. Indeed, the blade then behaves like an additional reinforcement, working in tension. This force is all the more important in the "off-piste position" than in the "on-piste position". In fact, if the second anchoring 14 and the blade 24 are not blocked in the "on-piste position", and the latter retains its ability to slide, the effect of the tension structure 6 on the flexibility of the ski is also insignificant in counter-bending.

A tensioning device 32 can be provided whose retention in the "off-piste position" is conditioned by the use of the ski, for example conditioned by the presence of an alpine ski boot in the safety bindings 2. In this way, the skis cannot be stored while the tension structure is tensioned. Indeed, a substantial tensioning of the skis for too long may result in modifying their mechanical characteristics, or even damaging them irremediably.

Figure 12:
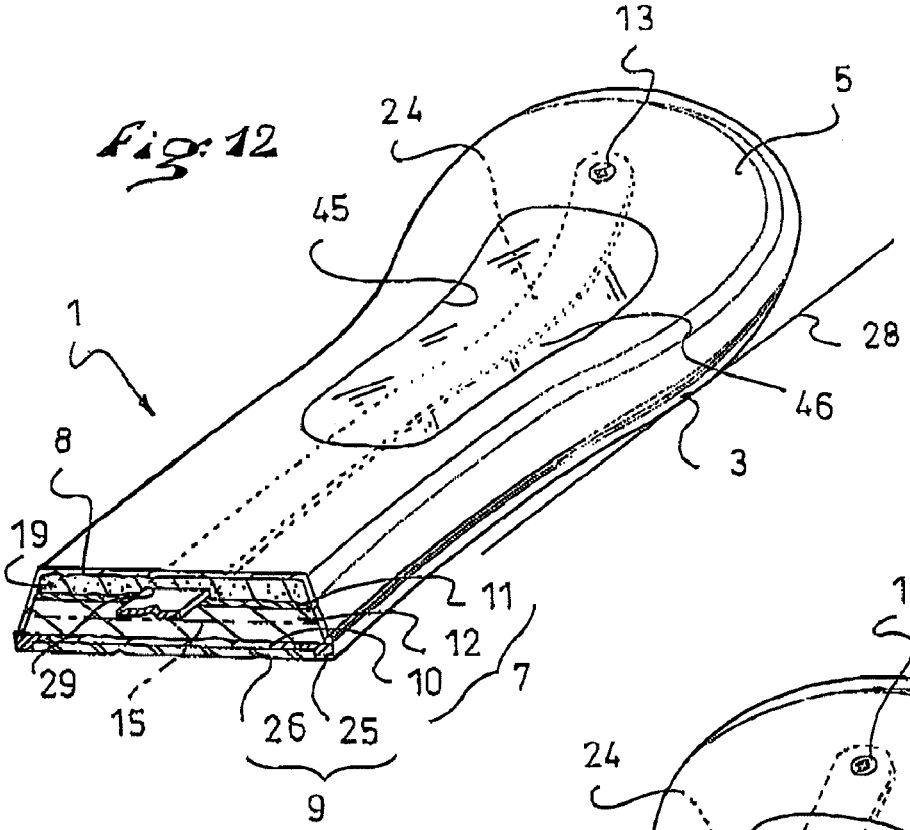
FIG. 12 is a perspective view of the front portion of a ski according to a second embodiment of the invention, when the latter is adjusted in the "on-piste position"
Figure 13:
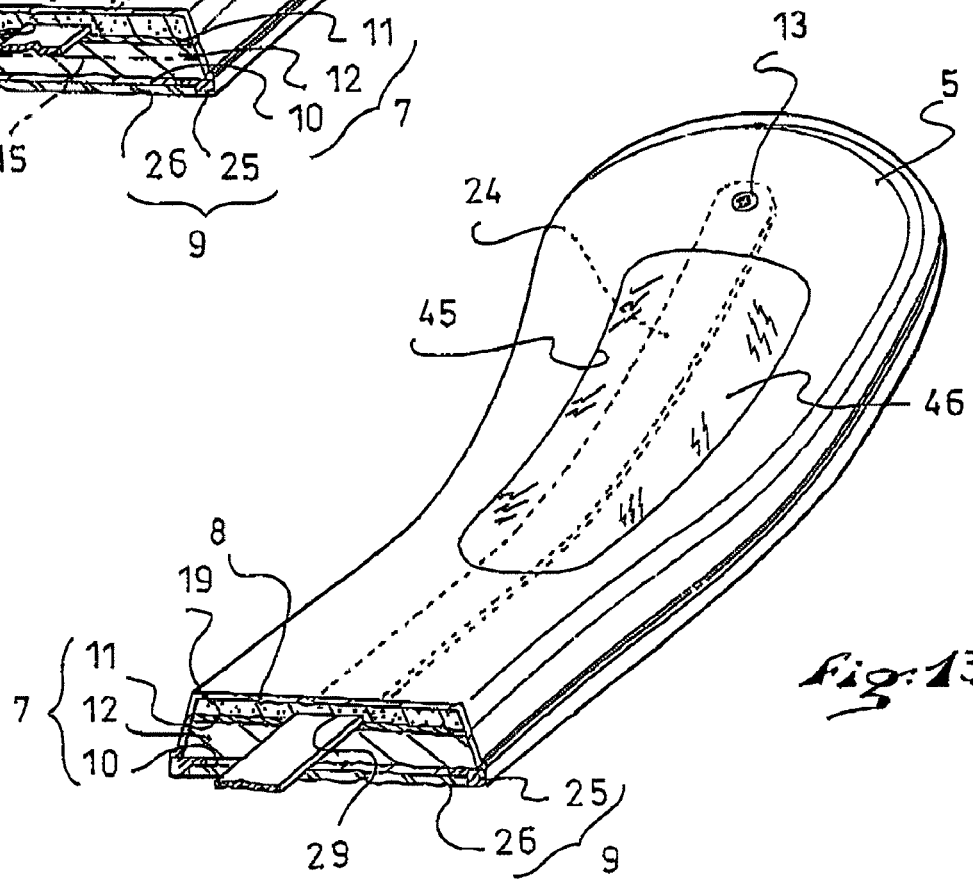
FIG. 13 is a view similar to FIG. 12, when the ski is adjusted in the "off-piste position".

FIGS. 12 and 13 show a second embodiment of the invention. This embodiment differs from the first embodiment only by the presence of a flexible portion in the protective and decorative structure. Another detailed description of all the elements is not provided again here, due to the similarities with the first embodiment, The ski 1 includes a structural unit 7, a gliding structure 9, and a protective and decorative structure 8. The tension structure 6, or traction structure, is arranged between a first anchoring 13 positioned forward of the shovel contact point 3 (PCS) and a second anchoring 14 positioned rearward of the shovel contact point.

The tension structure 6 is arranged in the over-neutral-axis volume 16, i.e., above the neutral axis 15. The major portion of the length of the tension structure 6, which is constituted by a blade 24, is located above the structural unit 7 of the ski 1; in other words, above the "engine" of the ski.

Within the protective and decorative structure is a window 45, which is positioned in the most curved zone of the front portion of the ski. This is the zone in which the shovel originates. The window has a length between 10 and 30 cm, and a width comprised between the width of the blade 24 and the width of ski 1.

A screen 46 covers the window 45 to guarantee sealing and to mask the blade. The screen 41 is made of an extensible and elastic material.

FIG. 12, the ski is shown in the "on-piste position". The blade 24, which is not tensioned, is in the tunnel 29. The screen 46 is positioned in continuity with the protective and decorative structure 8.

In FIG. 13, the ski is shown in the "off-piste position". The blade 24 is put in tension by the tensioning device. Due to the presence of the window 45, the blade 24 no longer contacts the structural unit 7 in the zone of the window 45. The blade 24 extends from the protective and decorative structure 8 along the window 45. It remains however beneath the screen 46, which stretches in order to accompany its movement.

In this embodiment, the tension on the blade 24 is more effective in raising the shove because the blade, when tensioned, can be positioned along a more direct profile between the first and the second anchoring. Borrowing a term from geometry, it can be said that the blade 24 lies on the chord in the window 45.

In the several embodiments described hereinabove, the blade 24 is positioned on the upper reinforcement, over the entire length of the latter. However, other embodiments of the invention have the blade passing beneath the upper reinforcement, over a small portion of its length, it being understood that the major portion of the length of the blade remains above the neutral axis, and, in a particular embodiment, above the upper reinforcement. Such embodiments make it possible to have non-linear deformation zones. In the zones where the blade is above the reinforcement, the deformation of the ski is substantial in the off-piste position, while in the zones where the blade is beneath the reinforcement, the deformation is smaller, even unnoticeable. Another structure makes it possible to have non-linear deformations. It involves maintaining the blade above the upper reinforcement over its entire length, and positioning a point reinforcement over it, in certain locations; the point reinforcement(s) being capable of having a length between 2 cm and 20 cm.

The invention is not limited to the several particular embodiments described hereinabove by way of example, but covers any equivalent embodiments.

The invention claimed is:

1. A ski comprising:

a structural unit comprising:

at least one lower reinforcement;

at least one upper reinforcement;

an intermediate structure positioned between the upper reinforcement and the lower reinforcement;

a gliding structure;

a decorative and protective structure;

the ski having a camber such that, with the gliding structure positioned on a planar surface, the ski rests on a shovel contact point and a tail contact point;

the ski further comprising a tension structure to exert a tension force between a first anchoring positioned longitudinally forward of the shovel contact point and a second anchoring positioned longitudinally rearward of the shovel contact point;

the tension structure being positioned, along a majority of a length of the tension structure, beneath the decorative and protective structure;

the tension structure being positioned, along a majority of the length of the tension structure, above a neutral axis of the ski;

the tension structure further comprising a tensioning device for positioning the second anchoring in at least two positions separated longitudinally from one another by a predetermined distance.

2. A ski according to claim 1, wherein:

the tension structure is positioned, along a majority of the length of the tension structure, above the upper reinforcement.

3. A ski according to claim 1, wherein:

said predetermined distance is between 0.5 mm and 10.0 mm.

4. A ski according to claim 1, wherein:

said predetermined distance is between 1.0 mm and 7.0 mm.

5. A ski according to claim 1, wherein:

the tension structure includes a blade extending between the first anchoring and the second anchoring.

6. A ski according to claim 5, wherein:

the decorative and protective structure includes a window;

the blade extends across the window.

7. A ski according to claim 5, wherein:

a filler is positioned between the decorative and protective structure and the upper reinforcement; and a tunnel is arranged in the filler in order to receive the blade.

8. A ski according to claim 1, wherein:

the tension structure includes an elastic mechanism.

9. A ski according to claim 1, wherein:

the ski further comprises a binding zone for binding a boot to the ski;

the tension structure extends rearward no further than the binding zone.

10. A ski comprising:

a structural unit comprising:

at least one lower reinforcement;

at least one upper reinforcement, including an uppermost reinforcement;

a core structure positioned between the upper reinforcement and the lower reinforcement;

a gliding structure;

a decorative and protective structure;

the ski having a camber such that, with the gliding structure positioned on a planar surface, the ski rests on a shovel contact point and a tail contact point;

the ski further comprising a tension structure to exert a tension force between a first anchoring positioned longitudinally forward of the shovel contact point and a second anchoring positioned longitudinally rearward of the shovel contact point;

the tension structure being positioned, along a majority of a length of the tension structure, beneath the decorative and protective structure;

the tension structure being positioned, along a majority of the length of the tension structure, above and higher than the structural unit.

11. A ski according to claim 10, wherein:

the tension structure further comprises a tensioning device for positioning the second anchoring in at least two positions separated longitudinally from one another by a predetermined distance.

12. A ski according to claim 11, wherein:

said predetermined distance is between 0.5 mm and 10.0 mm.

13. A ski according to claim 11, wherein:

said predetermined distance is between 1.0 mm and 7.0 mm.

14. A ski according to claim 10, wherein:

the ski further comprises a binding zone for binding a boot to the ski;

the tension structure extends rearward no further than the binding zone.

15. A ski according to claim 10, wherein:

the tension structure includes a blade extending between the first anchoring and the second anchoring.

16. A ski according to claim 15, wherein:

an entirety of the blade extends beneath the decorative and protective structure.

17. A ski according to claim 16, wherein:

the ski further comprises a binding zone for binding a boot to the ski;

the entirety of the blade extends no further rearward than the binding zone.

18. A ski according to claim 15, wherein:

the decorative and protective structure includes a window;

the blade extends across the window.

19. A ski according to claim 15, wherein:

a filler is positioned between the decorative and protective structure and the uppermost reinforcement;

a tunnel is arranged in the filler, the blade extending through the tunnel.

20. A ski according to claim 19, wherein:

the filler comprises a foam, the filler not being part of the structural unit.

21. A ski according to claim 19, wherein:

the blade is longitudinally slidable within the tunnel relative to the uppermost reinforcement and relative to the filler.

22. A ski according to claim 15, wherein:

the tension structure includes an elastic mechanism to absorb shocks caused by longitudinal movements of the blade during use of the ski.

23. A ski according to claim 10, wherein:

the tension structure further comprises a tensioning device structured and arranged to adjust the tension force to move the shovel selectively to at least either of two different positions.

24. A ski according to claim 23, wherein:

the tension structure includes a blade extending between the first anchoring and the second anchoring;

the tensioning device is structured and arranged to exert the tension force longitudinally along the blade.

25. A ski according to claim 24, wherein:

the tensioning device further comprises a tool-less manipulatable member structured and arranged to be accessible to the skier outside of the decorative and protective structure to adjust the tension force of the blade.

26. A ski according to claim 25, wherein:

the manipulatable member is operatively connected to the blade for movement of the second anchoring to at least two different positions separated longitudinally from one another by a predetermined distance, said two different positions of the second anchoring corresponding to respective ones of the two different positions of the shovel.

27. A ski according to claim 23, wherein:

the two different positions of the shovel are an on-piste shovel position and an off-piste shovel position.

28. A ski according to claim 26, wherein:

the two different positions of the shovel are an on-piste shovel position and an off-piste shovel position.

* * * * *